United States Patent [19]

Ishii

[11] 4,300,128

[45] Nov. 10, 1981

[54] MOTOR ACTUATED BELL

[75] Inventor: Tadashi Ishii, Kunitachi, Japan

[73] Assignee: Kobishi Electric Co., Ltd., Tokyo, Japan

[21] Appl. No.: 185,316

[22] Filed: Sep. 8, 1980

[51] Int. Cl.[3] ..... G10K 1/065

[52] U.S. Cl. ..... 340/392; 340/396; 340/399

[58] Field of Search ..... 340/390, 392, 396, 399; 84/103; 116/155

[56] References Cited

U.S. PATENT DOCUMENTS 4,255,744 3/1981 Link ..... 340/392

*Primary Examiner*—Harold I. Pitts

*Attorney, Agent, or Firm*—Darby & Darby

[57] ABSTRACT

A motor actuated bell comprises a pneumatic actuator. A hammer is operatively associated so as to be movable into striking contact with an associated gong to produce bell sound.

7 Claims, 3 Drawing Figures

MOTOR ACTUATED BELL

BACKGROUND OF THE INVENTION

1. Field of the Invention

This invention relates to motor actuated bells of the type in which a motor drives a hammer through a transmission means into striking contact with an associated gong to produce bell sound.

2. Prior Art

One conventional motor actuated bell 100, as shown in FIG. 1, comprises an electric motor 101 having a drive shaft 102 on which a pinion 103 is mounted. A gear 104 is mounted on a shaft 105 which is journaled in a frame 106, the gear 104 being in mesh with the pinion 103. A disc 107 is secured at its center to one end of the shaft 105 and has a pin 107*a* disposed in offset or eccentric relation to the center of the disc 107. A bushing 108 is fitted into a hole in support plate 109 pivotally mounted on the frame 106 at its one end 109*a*. A hammer 110 has a head portion 110*a* slidably extending through the frame 106, and a shank 110*b* of a smaller diameter coupled to the bushing 108. A coil spring 111 acts between the hammer head 110*a* and the bushing 108 while a coil spring 112 acts between the support plate 109 and a collar 108*a* mounted on the bushing 108. A connecting plate 113 is pivotally connected at one end thereof to the support plate 109, the connecting plate 113 having a slot 113*a* formed through the other end thereof. When the motor 101 is driven, the disc 107 is rotated through the meshed pinion 103 and gear 104 so that the connecting plate 13 is reciprocally moved along its axis through the eccentric pin 107*a* slidably received in the slot 113*a*. The reciprocal movement of the connecting plate 113 causes the support plate 109 to pivotally move about its one end 109*a* so that the hammer 110 is driven for movement along its axis toward and away from a gong 114. Thus, the hammer head 110*a* is caused to strike against the gong 114 to produce bell sound. This known motor actuated bell has a considerable number of component parts and hence is complicated in construction.

SUMMARY OF THE INVENTION

It is therefore an object of this invention to provide a motor actuated bell which has a relatively small number of component parts and hence is simple in construction.

Another object is to provide a motor actuated bell which has a pneumatic actuator for driving a hammer into striking contact with a gong.

According to the present invention, there is provided a motor actuated bell which comprises a base; a gong mounted on the base; a motor mounted on the base and having a rotatable drive shaft; a pneumatic actuator mounted on the base; a transmission means connected between the motor drive shaft and the pneumatic actuator; and a hammer operatively associated with the pneumatic actuator for being moved into striking contact with the gong.

Other advantages, features and additional objects of the present invention will become manifest to those versed in the art upon making reference to the detailed description and the accompanying sheets of drawings in which preferred embodiments incorporating the principles of the present invention are shown by way of illustrative examples.

DESCRIPTION OF THE PREFERRED EMBODIMENTS

Figure 1:
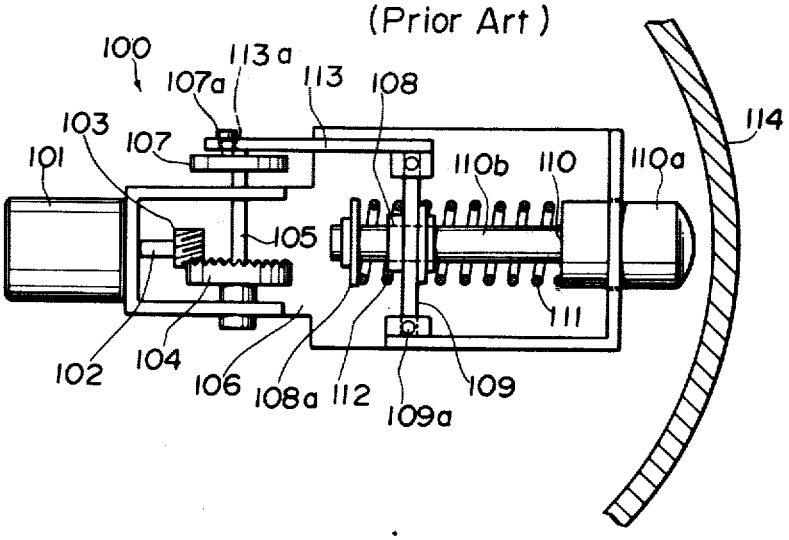
Fig. 1 (Prior Art)
FIG. 1 is a plan view of a motor actuated bell provided in accordance with the prior art.
Figure 2:
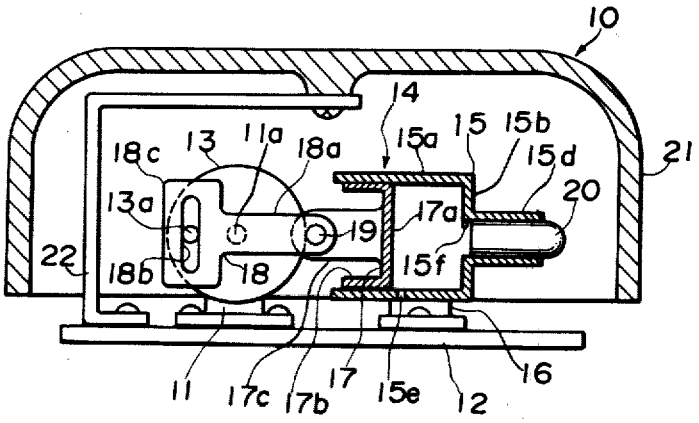
FIG. 2 is a cross-sectional view of a motor actuated bell constructed in accordance with the invention.

FIG. 2 shows a motor actuated bell 10 constructed in accordance with the invention. An electric motor 11 is mounted on a base 12 and has a drive shaft 11*a*. A disc 13 is fixedly mounted at its center on the motor drive shaft 11*a l for rotation therewith, the disc 13 having a pin 13a* disposed in offset or eccentric relation to its center. The motor actuated bell 10 comprises a pneumatic actuator 14 for actuating a hammer 20, the pneumatic actuator being in the form of an air cylinder. The air cylinder 14 includes a cylinder member 15 having a base portion 15*a* with an apertured end plate 15*b*, and a tubular portion 15*d* of a smaller diameter extending from the end plate 15*b* in coaxial relation thereto. The base portion 15*a* has a port 15*e* formed therethrough intermediate the opposite ends thereof. The cylinder member 15 is mounted on the base 12 by a mounting member 16 with its axis parallel to the base 12. The air cylinder 14 also includes a piston 17 having a circular portion 17*a* and a peripheral flange 17*b* formed around the circular portion, the piston 17 being received in the base portion 15*a* with the peripheral flange 17*b* in sliding contact with the bore of the base portion 15*a*. A piston rod 17*c* is formed integrally with and extends from the circular portion 17*a* in a direction away from the end plate 15*b*. A connecting member 18 of a generally T-shape has a leg portion 18*a* rigidly connected to the piston rod 17*c* by a pin 19. An elongated slot 18*b* is formed through a head portion 18*c* of the connecting member 18, the slot extending perpendicular to the axis of the leg portion 18*a*. The eccentric pin 13*a* is received in the slot 18*b* for sliding movement therealong. The hammer 20 is received in the tubular portion 15*d* of the cylinder member 15 with its peripheral surface in sliding contact with the bore of the portion 15*d*. The tubular portion 15*d* has a projection 15*f* formed on the inner surface thereof immediately adjacent to the end plate 15*b*, the projection serving to prevent the hammer 20 from intruding into the base portion 15*a*.

The base 12 is connected to an inverted cup-shaped gong 21 by a connecting plate 22 of a generally channel-shaped cross-section.

In operation, the motor 11 is first driven to rotate the disc 13 in a clockwise direction (FIG. 2) so that the eccentric pin 13*a* slides along the upper half of the slot 18*b* to allow the connecting member 18 to move in a right-hand direction. The movement of the connecting member 18 in the right-hand direction causes the piston 17 to slidingly move along the base portion 15*a* of the cylinder member 15 to compress the air in the cylinder member 15 so that the hammer 20 is caused to slidingly move along the tubular portion 15*d* into striking contact with the inner wall of the gong 21 to produce bell sound. Then, the eccentric pin 13*a* slides along the lower half of the slot 18*b* to allow the piston 17 to move in a left-hand direction so that the hammer 20 returns to a retracted position remote from the gong 21. This cycle of operation is continuously repeated to produce bell sound. The piston 17 is moved toward the gong 21 to shut off the port 15*e*. As the piston continues moving, a small amount of the compressed air escapes through the tubular portion 15*d* along the hammer 20. As the piston 17 is moved away from the gong 21, a negative pressure is first created in the cylinder member 15 to draw the hammer 20 away from the gong 21. Then, the piston 17 is moved toward the motor 11 beyond the port 15*e*, so that the ambient air is introduced through the port 15*e* into the cylinder member 15 to increase the pressure in the cylinder member 15 to the atmospheric, thereby compensating for the above-mentioned leakage of the air along the hammer 20.

Figure 3:
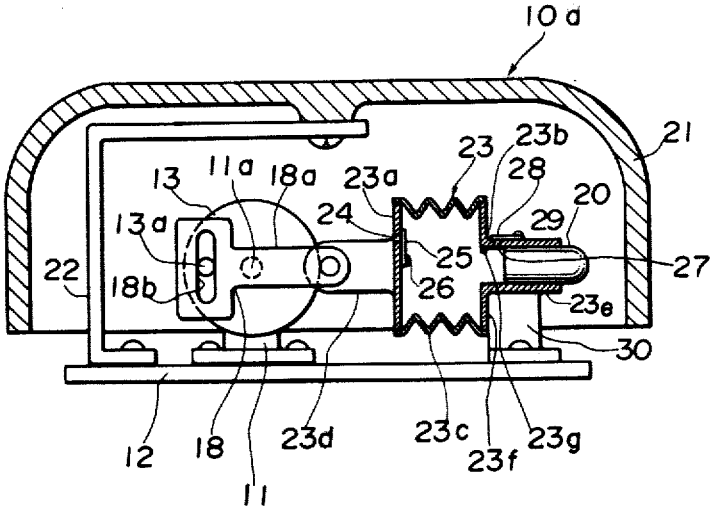
FIG. 3 is a view similar to FIG. 2 but showing a modified bell.

FIG. 3 shows a modified motor actuated bell 10*a* which differs from the motor actuated 10 shown in FIG. 2 in that a modified pneumatic actuator 23 is provided for actuating the hammer 20. The pneumatic actuator 23 comprises a bellows assembly which comprises an end plate 23*a* in the form of a disc, an end member 23*b* and a bellows 23*c* of a circular cross-section extending between the end plate 23*a* and the end member 23*b*. A connecting rod 23*d* is formed integrally with and extends from the end plate 23*a* and is coupled to the connecting member 18 as described above for the piston rod 17*c*. The end member 23*b* has a tubular portion 23*e* and a circular flange 23*f* formed around one end of the tubular portion 23*e*. The bellows 23*c* is secured at its opposite ends to the end plate 23*a* and the flang 23*f* which are equal in diameter. The bellows assembly 23 is mounted on the base 12 by a mounting member 30. A port 24 is formed through the end plate 23*a*. A valve member 25 in the form of a leaf spring is attached by a pin 26 to the inner surface of the end place 23*a* for normally closing the port 24. Also, another port 27 is formed through the tubular portion 23*e* adjacent to the flange 23*f*. A second valve member 28 in the form of a leaf spring is attached by a pin 29 to the outer peripheral surface of the tubular portion 23*e* for normally closing the port 27. The hammer 20 is slidably received in the tubular portion 23*e* and is engageable with a projection 23*g*, as described above for the tubular portion 15*d*.

In operation, the motor 11 is driven to first move the end plate 23*a* in a right-hand direction (FIG. 3) through the disc 13 with the eccentric pin 13*a* and the connecting member 18 in the manner as described above for the motor actuated bell 10 shown in FIG. 2. The thus moving end plate 23*a* axially contracts the bellows 23*c* to compress the air in the bellows assembly 23 so that the hammer 20 is caused to slidingly move along the tubular portion 23*e* into striking contact with the inner wall of the gong 21 to produce bell sound. Then, the end plate 23*a* is moved in the left-hand direction to expand the contracted bellows 23*c* so that the hammer 20 slides along the tubular portion 23*e* away from the gong 21. This cycle of operation is continuously repeated to produce bell sound. When the pressure in the bellows assembly 23 reaches a predetermined level during the movement of the end plate 23*a* toward the gong 21, the valve member 28 opens the port 27 to escape part of the compressed air therethrough. This prevents the bellows 23*c* of a flexible material from being damaged by the high pressure created in the bellows assembly 23. As the end plate 23*a* is moved away from the gong 21, a negative pressure is created in the bellows assembly 23 to draw the hammer 20 away from the gong along the tubular portion 23*e*, as described above for the cylinder member 15. When this negative pressure reaches a predetermined level, the valve member 25 opens the port 24 to introduce the ambient air into the bellows assembly 23 therethrough to increase the pressure therein to the atmospheric.

By virtue of the provision of the pneumatic actuator, the bells are quite simple in construction.

While the motor actuated bells according to this invention have been specifically shown and described herein, the invention itself is not to be restricted by the exact showing of the drawings or the description thereof. For example, a speed reducer may be connected to the motor drive shaft to actuate the hammer at a lower speed.

What is claimed is:

1. A motor actuated bell comprising:

(a) a base;

(b) a gong mounted on said base;

(c) a motor mounted on said base and having a rotatable drive shaft;

(d) a pneumatic actuator mounted on said base;

(e) a transmission means connected between said motor drive shaft and said pneumatic actuator; and (f) a hammer operatively associated with said pneumatic actuator for being moved into striking contact with said gong.

2. A bell according to claim 1, in which said transmission means comprises a disc with an eccentric pin connected to said motor drive shaft, and a connecting member connected at one end thereof to said pneumatic actuator and having a slot at the other end in which said eccentric pin is received for sliding movement therealong so that said connecting member is moved along its axis when the motor is driven.

3. A bell according to claim 1, in which said pneumatic actuator comprises an air cylinder including a cylinder member and a piston slidably received in said cylinder member, said piston being connected to said transmission means, said cylinder member having a base portion and a tubular portion of a smaller diameter extending from said base portion, said hammer being slidably received in said tubular portion for movement therealong, said piston being movable from a retracted position to an extended position to compress the air in said cylinder member for moving said hammer along said tubular portion into striking contact with said gong, and said cylinder member having means for introducing the ambient air thereinto during the movement of said piston from its extended to retracted position.

4. A bell according to claim 3, in which said air introducing means comprises a port formed through said base portion.

5. A bell according to claim 1, in which said pneumatic actuator comprises a bellows assembly including an end plate, an end member witha tublar portion and a bellows extending between said end plate and said end member, said end plate being connected to said transmission means, said hammer being slidably received in said tubular portion for movement therealong, said bellows being contractible to compress the air in said bellows assembly for moving said hammer along said tubular portion into striking contact with said gong, and said bellows assembly having means for intrducing the ambient air thereinto while said contracted bellows is being expanded.

6. A bell according to claim 5, in which said air introducing means comprises a valve mounted on one of said end plate and end member.

7. A bell according to claim 5, in which another valve is mounted on one of said end plate and end member for escaping part of the compressed air when the pressure in said bellows assembly reaches a predetermined level while said bellows is being contracted.

* * * * *